US012503822B2

(12) United States Patent
Venetz et al.

(10) Patent No.: US 12,503,822 B2
(45) Date of Patent: Dec. 23, 2025

(54) DETENSIONING SYSTEM AND A METHOD FOR DETENSIONING A STRUCTURAL ELEMENT OR A TENSIONING ELEMENT

(71) Applicant: VSL International AG, Bern (CH)

(72) Inventors: Christian Venetz, Hong Kong (HK); Rachid Annan, Rapperswil (CH)

(73) Assignee: VSL International AG, Bern (CH)

( * ) Notice: Subject to any disclaimer, the term of this patent is extended or adjusted under 35 U.S.C. 154(b) by 0 days.

(21) Appl. No.: 18/689,287

(22) PCT Filed: Sep. 24, 2021

(86) PCT No.: PCT/EP2021/076418
§ 371 (c)(1),
(2) Date: Mar. 5, 2024

(87) PCT Pub. No.: WO2023/046298
PCT Pub. Date: Mar. 30, 2023

(65) Prior Publication Data

US 2025/0129558 A1 Apr. 24, 2025

(51) Int. Cl.
*E01D 22/00* (2006.01)
*E01D 19/16* (2006.01)
*E04C 5/12* (2006.01)

(52) U.S. Cl.
CPC ..... *E01D 22/00* (2013.01); *E01D 19/16* (2013.01); *E04C 5/12* (2013.01)

(58) Field of Classification Search
CPC ..... E01D 22/00; E01D 19/16; E04C 5/12
See application file for complete search history.

(56) References Cited

U.S. PATENT DOCUMENTS 4,805,877 A * 2/1989 Hoekstra ..... G01L 5/06 15/257.06
6,701,599 B2 * 3/2004 Stubler ..... E04C 5/12 29/407.08
2002/0113231 A1 * 8/2002 Stubler ..... E04G 23/02 254/134.3 R

FOREIGN PATENT DOCUMENTS

DE 102017201907 8/2018
EP 3808899 4/2021

OTHER PUBLICATIONS

International Search Report and Written Opinion for PCT/EP2021/076418, dated Jun. 17, 2022, 10 pages.

* cited by examiner

*Primary Examiner* — Ryan J. Walters
(74) *Attorney, Agent, or Firm* — Tucker Ellis LLP

(57) ABSTRACT

The invention relates to a detensioning system and a method thereof for detensioning a structural element or a tensioning element, which includes;

At least one clamping device arranged on at least one side of the portion of the structural element or the tensioning element to be detensioned, wherein the clamping device having an internal surface profile, arranged to form a substantially elongated, annular cavity surrounding the structural element or the tensioning element to be detensioned, including an empty space for receiving one or more inner elements to be introduced therein, wherein the substantially elongated, annular cavity includes a gradually declining diameter along the longitudinal axis of the elongated annular cavity shaped by at least one peak and one groove of the internal surface profile of the clamping device;

(Continued)

Two or more stressbars arranged to connect between an anchored structure and the clamping device which is arranged on one side of the portion of the structural element or the tensioning element to be detensioned, or arranged to connect between the clamping devices arranged on both sides of the portion of the structural element or tensioning element to be detensioned;

Two or more stressbar hydraulic cylinders, wherein each of the stressbar hydraulic cylinder is either mounted directly on the clamping device, or on a stressing chair which in turn is bearing against the clamping device located on at least one side of the portion structural element or the tensioning element to be detensioned.

19 Claims, 12 Drawing Sheets

DETENSIONING SYSTEM AND A METHOD FOR DETENSIONING A STRUCTURAL ELEMENT OR A TENSIONING ELEMENT

TECHNICAL FIELD OF THE INVENTION

The present invention relates to the field of civil engineering involving structural elements or tensioning elements e.g. tendons, which are to be detensioned, demounted or replaced. In addition, the detensioning system and method according to the present invention are suitable to detension structural elements and/or tensioning elements that are being pre-tensioned at a stressing force of for instance 4000 kN or 8000 kN or more.

BACKGROUND OF THE INVENTION

Structural elements or tensioning elements of civil engineering structures such as bridges or columns need to be maintained or replaced from time to time in order to ensure their safety. These pre-tensioned structural elements or tensioning elements needs to be detensioned in a controlled manner before being demounted and replaced completely.

Patent document DE102017201907 A1 discloses a method for replacing a tensioning element of a large civil structure such as a suspension bridge with towers in the structure thereof. A number of mobile temporary hangers are placed on the upper cable to be replaced, the cable to be replaced is located in the lower portion of these hangers and the cable is removed from the anchors thanks to the mobile temporary hangers that are connected to upper cable. These hangers can be moved towards the deck of the bridge in order to remove the cable to be replaced. This solution is complicated to set up. Moreover, it is only suitable to detension to certain types of structural elements or tensioning elements such as the one described therein.

A "window cutting method" is also known in the art for the detensioning of structural elements or tensioning elements of a civil structural. This de-tensioning method consists of providing several windows along the tendon (tension element), where the protecting sheathing and grout surrounding the strands is removed. The tendon (tension element) is then cut by gas torch or remote-controlled diamond wire strand by strand in one or two windows. As the strands are cut, the force in the remaining strands increases and eventually rupture due to overstress. The sudden rupture of the remaining strands leads to a high residual force release which cannot be fully controlled and might in the process of sudden release cause an impact to the surrounding structure. The impact of the sudden residual force release may be reduced by providing additional damping; however, the force release is not fully controlled and there remains a degree of uncertainty to the implications to the surrounding structure. The above description covers the usual case of a tendon (tension member) formed by a set of individual strands, but it is also applicable to other types of tendon (tension member), e. g. tendon composed of wires or ropes Therefore, there remains a need to find an improved system and improved method for a fully controlled detensioning method and complete force release of the tension element to enable the replacement of structural elements and/or tensioning elements that are being pre-tensioned or pre-stressed.

SUMMARY OF THE INVENTION

In the present invention, it is proposed that the tendon force of the structural element or the tensioning element is transferred to the stressbars of a bracket system (e.g. presently described detensioning system) clamped to the structural element or tensioning element (e.g. tendon) which are being pre-stressed, with the objective to reduce the tendon force in at least a portion of a structural element or tensioning element. The tendon is then cut in said portion which has been detensioned, for example in between two activated clamping devices. Once the tendon has been cut, the restrained stressbars of the detensioning system can be released in a controlled manner by de-tensioning the stressbars for instance through hydraulic cylinders, which in turn will release the tendon force over the full tendon length.

The detensioning system according to the present invention can be realised through at least one clamping device. Nevertheless, it is also foreseeable that the clamping device is provided on both sides of the portion of the structural element or the tensioning element to be detensioned. Thanks to the detensioning system which comprises at least one clamping device, wherein the clamping device provides a substantially elongated, annular cavity comprising a gradually declining diameter along a longitudinal axis of the elongated annular cavity shaped by at least one peak and one groove on the internal surface profile of the clamping device, the detensioning system and particularly the clamping device according to the present invention can be built more compact compared to other clamping system, for instance a clamping system comprising a cylindrical annular cavity, as the clamping device according to the present invention allows higher gripping force to the tendon.

Moreover, the clamping device according to the present invention may comprise for instance one, or more preferably with two half conical clamps (e.g. machined high-strength steel sections), which may then be bolted together to form a conical stressing clamp, comprising at least one substantially annular cavity. Apart from the two halve (or "U-shape") conical clamps, the clamping device may also comprise other mechanical components such as sealing plates, bolts, gasket seals, hydraulic cylinders and etc. to form a functioning clamping system. The detensioning system further comprises stressbars to allow a portion (e.g. between two clamping devices) of the tendon force to be transferred thereto before detensioning of the remaining length of the tendon is taken place. Prior to the installation of the detensioning system such as the clamping device, the sheath and/or grout around the surface of the tendon may be chiselled away partially or completely so as to increase the friction (or the grip) of the clamping device to the tendon (when the inner element is introduced to the annular cavity). One or more inner elements can be introduced to the substantially elongated, annular cavity provided by the conical clamping device. The inner element can be a preform element or can be formed by a filler hardening material such as a grout.

A first aspect of the invention is to provide a detensioning system for detensioning a portion of a structural element or a tensioning element, comprising At least one clamping device arranged on at least one side of the portion of the structural element or the tensioning element to be detensioned, wherein the clamping device having an internal surface profile, arranged to form a substantially elongated, annular cavity surrounding the structural element or the tensioning element to be detensioned, comprising an empty space for receiving one or more inner elements to be introduced therein, wherein the substantially elongated, annular cavity comprises a gradually declining diameter along the longitudinal axis of the elongated annular cavity shaped by at least one peak and one groove of the internal surface profile of the clamping device;

Two or more stressbars arranged to connect between an anchored structure and the clamping device which is arranged on one side of the portion of the structural element or the tensioning element to be detensioned, or arranged to connect between the clamping devices arranged on both sides of the portion of the structural element or tensioning element to be detensioned;

Two or more stressbar hydraulic cylinders, wherein each of the stressbar hydraulic cylinder is either mounted directly on the clamping device, or on a stressing chair which in turn is bearing against the clamping device located on at least one side of the portion structural element or the tensioning element to be detensioned.

A second aspect of the invention is to provide a detensioning method for detensioning a portion of the structural element or a tensioning element, comprising the following steps:

a) Removing of sheath and/or grout covering the portion of the structural element or the tensioning element in case such sheath and/or grout is present, thereby exposing a core element of the structural element of the tensioning element;

b) Placing at least one clamping device on the exposed core element, wherein the at least one clamping device is positioned on at least one side of the portion of the structural element or the tensioning element to be detensioned if another side of the portion is anchored to an anchored element, or placing the clamping devices in between the portion of the structural element of the tensioning element to be detensioned, wherein the clamping device having an internal surface profile is configured to form a substantially elongated, annular cavity surrounding the structural element or the tensioning element to be detensioned, comprising an empty space in order to be able to introduce one or more inner elements within the substantially elongated, annular cavity, wherein the substantially elongated, annular cavity comprises a gradually declining diameter along the longitudinal axis of the elongated annular cavity shaped by at least one peak and one groove of the internal surface profile of the clamping device;

c) Joining the clamping devices arranged on at least one side of the portion of the structural element or the tensioning element to be detensioned with at least two stressbars, bearing plates, washers, and nuts;

d) Activating stressbar hydraulic cylinders which are mounted either directly to the clamping device, or mounted on a stressing chair which in turn is bearing against the clamping device in order to transfer the load from the structural element or the tensioning element to the stressbars, wherein the stressbar hydraulic cylinders are actuated until reaching approximately the same or slightly below the original load carried by the structural element or the tensioning element;

e) Retaining the load transferred to the stressbars joining the clamping devices on each side of the portion of the structural element or the tensioning element;

f) Cutting the core element of the portion of the structural element or the tensioning element to be detensioned while holding the load and strain of the structural element or the tensioning element with the detensioning system;

g) Relaxing the stressbar hydraulic cylinders until the portion of the structural element or the tensioning element is completely detensioned.

According to a third aspect of the invention, it relates to a use of the detensioning system according to present invention in detensioning a portion of a structural element or a tensioning element.

According to some embodiments, each of the clamping device is formed by at least two half clamps, wherein the two half clamps are joined together by mechanical fixing means, wherein one or two clamping devices are provided to each side of the portion of the structural element or the tensioning element to be detensioned. This allows the clamping device to be installed and de-installed easily.

According to some embodiments, the clamping device comprises a surface profile, arranged to form a substantially elongated, annular cavity having multiple segments, defined by multiple grooves and peaks, wherein each of the segment of the annular cavity comprises a gradually declining diameter along the longitudinal axis of the elongated, annular cavity. This allows an even higher gripping force to the tendon.

According to some embodiments, the substantially elongated, annular cavity comprises one or more segments, wherein each segment of the annular cavity comprises at least one channel for introducing of the filler hardening material and at least one channel for venting of the filler hardening material, wherein the filler hardening material is introduced through the channel into the substantially elongated, annular cavity formed by the clamping device, such that the one or more inner elements that is hardened comprises a reversed impression of the internal surface profile of the clamping device, or comprises a similar impression as the surface profile of the annular cavity. This allows the filler hardening material to be introduced into the cavity.

According to some embodiments, the substantially elongated, annular cavity comprises one or more segments, wherein the segments are provided in a trapezoidal or a conical form, or a wedge when viewed from a longitudinal section, so as to increase the longitudinal force transferred between the structural element or the tensioning element to be detensioned and the clamping device, through the one or more inner elements. The different forms of the segment can be chosen based on the actual need and depends on the situation.

According to some embodiments, the substantially elongated, annular cavity comprises one or more segments, wherein each segment of the annular cavity is provided with same or different volumetric capacity for accepting the filler hardening material for the formation of the one or more inner elements such that each segment of the one or more inner elements comprises the same or different amount of filler hardening material.

According to some embodiments, the substantially elongated, annular cavity comprises a periphery with edges and/or a substantially linear periphery. In other words, the annular cavity formed by the clamping device may not have corners (round) or may have one or more edges and corners.

According to some embodiments, the substantially elongated, annular cavity comprises one or more segments, comprising a surface profile defining between two and ten segments or at least two, three, four, five, six, seven, eight or more segments, defined by multiple grooves and peaks, wherein each of the segment is provided in a conical shape, or a wedge when viewed from a longitudinal section. It has been found that generally the more the number of segments, the higher the gripping force to the tendon.

According to some embodiments, the substantially elongated, annular cavity comprises one or more segments, wherein each segment of the annular cavity is provided in form of a trapezoid or a cone, or a wedge when viewed from a longitudinal section, wherein the wedge angle is provided in between 5° and 65°, preferably between 10° and 60°, between 15° and 55°, between 20° and 50°, between 25° and 45°, between 30° and 40° or preferably at around 30°.

According to some embodiments, the one or more inner elements is made by a filler hardening material, which is a grout such as an epoxy-based or a concrete-based grout. Filler hardening material is advantageous over such as pre-forms as the shape is only formed upon the hardening of the hardening material.

According to some embodiments, one or more displacement sensors are provided either in between the clamping devices located on at least one side of the portion of the structural element or the tensioning element to be detensioned, or to the far end of the clamping devices to a fixed reference.

According to some embodiments, strain gauges are provided to the detensioning system, for instance the strain gauges are mounted on the surface of the portion of the structural element or tensioning element to be detensioned, in the filler material and/or at fixings between two half clamps.

According to some embodiments, a cutting machine such as a diamond wire cutting machine is provided and set up before stressing operation begins.

According to some embodiments, the clamping device configured to form one or more annular cavities comprises two half clamps, mechanical fixing means such as high strength bolts, debonding agent, sealing plates, sealant, stressbars and/or instrumentation for monitoring purposes such as through strain gauges, displacement sensors and/or video camera.

According to some embodiments, the detensioning method according to the present invention further comprising one or more steps of a) Injecting a grout or a filler hardening material into the substantially elongated, annular cavity through at least one channel for introducing the filler hardening material to form the one or more inner elements having reversed impression of the internal surface of the clamping device, or the same impression as the surface profile of the annular cavity formed by the clamping device;
b) Mounting or installing strain gauges and/or mechanical fixings means to the clamping device;
c) Applying a debonding agent on surfaces of the one or more annular cavities formed by the clamping device in order to minimize friction between clamping devices and filler material;
d) Flanging both ends of the clamping devices to enable fixing them together by mechanical fixing means such as high strength bolts;
e) In case two half clamps are used for forming the conical clamping device, first installing the lower half clamp followed by the upper half clamp at a desired position comprising one or more steps of (a) and (c) before aligning and bolting the two half clamps together;
f) Providing one or more sealing plates and/or seal such as silicon seal to the one or more annular cavities before injecting filler hardening material into the one or more annular cavities;
g) Carrying out a leak tightness test by applying vacuum before injection of the filler hardening material;
h) Vacuum-assisted injection of the filler hardening material;
i) Providing and setting up a cutting machine such as a diamond wire cutting machine before stressing operation begins;
j) Mounting a wire sensor at the cutting location on the portion of the structural element or tensioning element to be detensioned in order to enable the confirmation of cutting;
k) Instrumentation comprised of displacement sensors, strain gauges, video cameras, wire sensors and/or microphone to enable remote control monitoring from a centralized control desk from a safe working zone;
l) Cutting the core element of the portion of the structural element or the tensioning element to be detensioned.

By "about" or "approximately" in relation to a given numerical value, it is meant to include numerical values within 10% of the specified value. All values given in the present disclosure are to be understood to be complemented by the word "about", unless it is clear to the contrary from the context.

The indefinite article "a" or "an" does not exclude a plurality, thus should be treated broadly.

To this end, it is disclosed that the stressbar can be replaceable with other similar component or element having similar function. For instance, instead of stressbar, one or more strands or ropes can be used instead of the stressbars.

The term "structural element" as used herein refers to a basic component of a building structure which forms a structural frame building structure such as beams, pillars, roof terraces, slabs, columns, girders and/or other structural members and connections.

The term "tensioning element" as used herein refers to an element which carries tension and no compression. The tensioning element may be provided to such as bridge cable in order to support the main deck where the traffics flow. The tensioning element described herein may be for instance a tendon.

DETAILED DESCRIPTION OF THE INVENTION

Figure 1:
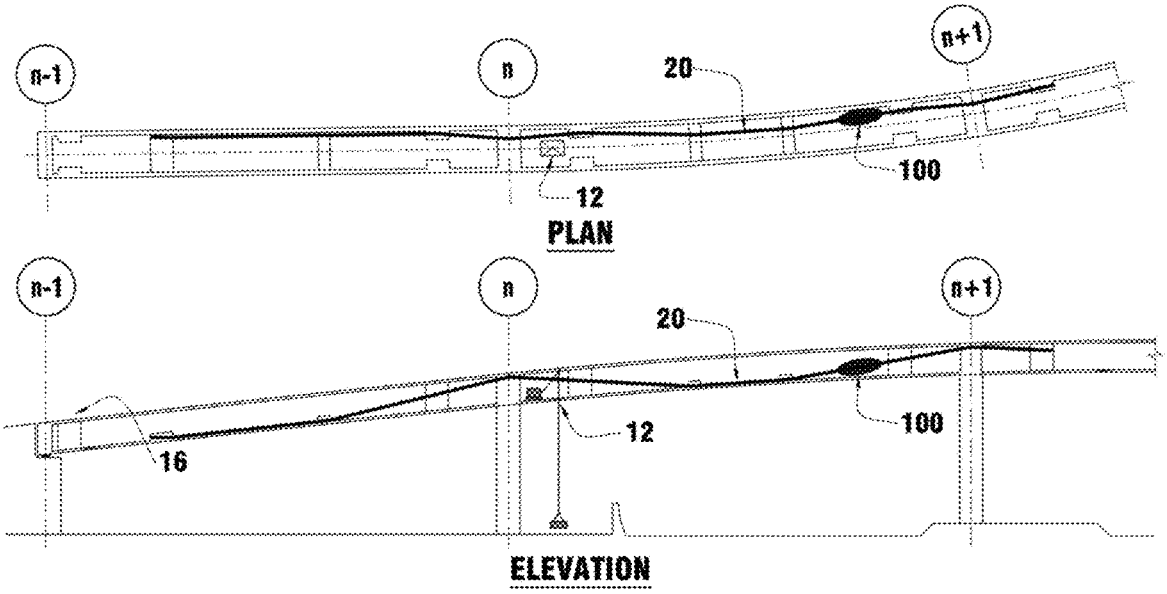
FIG. 1 shows a schematic plan view (top figure) and an elevational view (bottom figure) of a bridge structure with a typical external tendon arranged inside of a box girder anchored at either end.

The inventors of the present invention propose a detensioning system and a method for a controlled de-tensioning of the structural elements or tensioning elements (e.g. tendons) which have previously been pre-tensioned, involving one or more clamping devices of the detensioning system espoused herein. The clamping devices are mounted for example in between the cutting location, and both the clamping devices are stressed via stressbars against one another for instance to 90% of the tendon force before cutting the tendon. The detensioned tendon section (in between the clamping devices) can then be cut by for instance a diamond wire cutting machine, and subsequently the tendon can be de-tensioned in a controlled manner by de-tensioning the stressbars with hydraulic cylinders (e.g. jacks) until the entire tendon force of the tendon is released.

The structural elements or the tensioning elements to be repaired or replaced e.g. tendon, in the present context are usually pre-tensioned at a very high tension. For instance, the tendons can be stressed to at least 4000 kN or more. Before cutting the aged or damaged tendon, the tendon force has to be transferred so that the tension of the tendon can be detensioned in a controlled manner before the tendon can be safely cut. In doing so, at least one clamping devices is arranged on each side of the structural element or the tensioning element to be detensioned.

In case a detensioning system comprising one or more clamping devices are used to detension the tendon, annular cavity which is generally a cylindrical in shape formed by the clamping device may be suitable to be used in the detensioning operation. However, the cylindrical annual cavity has lower gripping force compared to the clamping device in the present invention, wherein the substantially elongated, annular cavity comprises a gradually declining diameter along the longitudinal axis of the annular cavity. This in turn allows a smaller and more compact clamping device as well as detensioning system. This is advantageous when limited space is available for the replacement work to be carried out.

According to the gist of the present invention, the detensioning system comprises at least one clamping device 120 arranged on at least one side of the portion 20*a* of the structural element or the tensioning element to be detensioned, wherein the clamping device 120 having an internal surface profile, arranged to form a substantially elongated, annular cavity 55*c* surrounding the structural element or the tensioning element to be detensioned, comprising an empty space for receiving one or more inner elements 55 to be introduced therein, wherein the substantially elongated, annular cavity comprises a gradually declining diameter along the longitudinal axis of the elongated annular cavity 55*c* shaped by at least one peak and one groove of the internal surface profile of the clamping device 120.

The inner element may be a preform element which is placed within the annular cavity of the clamping device (e.g. clamped by the clamping device), or may be a grout or a filler material to be introduced into the space within the annular cavity formed by the clamping device such that a filler hardening material having a reverse impression of the formwork can be formed encircling the structural element or the tensioning element to be detensioned.

FIG. 1A shows a representative of a civil structural i.e. bridge where the bridge structure comprises one or more tendons 20 to be replaced that are being installed within a box girder anchored at one 16 or both ends. In order to replace or to repair the tendon, workers may enter into the box girder or the duct through a manhole 12 to install the detensioning system 100 according to the present invention. In this example, the detensioning system 100 can be used for example to detension tendon having tendon size 5-31 (31 strands, 0.5") or 6-19 (19 strands, 0.6") with a tendon force of about 4300 kN, where the terminal end of the tendon may be abutted to an abutment.

Figure 2A:
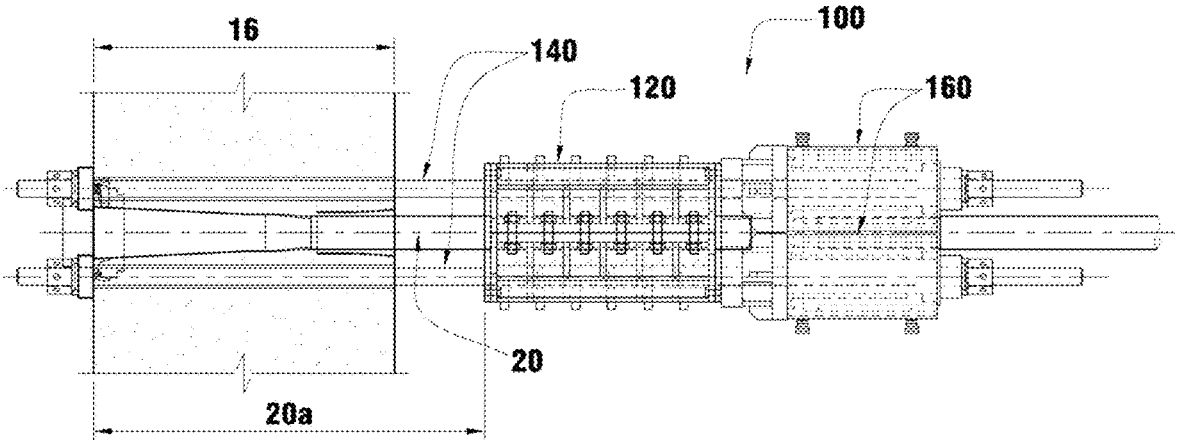
FIG. 2A shows a schematic side view of the detensioning system according to one embodiment of the present invention, wherein the detensioning system comprises only one clamping device to detension a portion of the structural element or the tensioning element.

FIG. 2A shows a general overview of the detensioning system according to an embodiment of the present invention. In this embodiment, the detensioning system 100 comprises only one clamping device 120 on one end and another end of the tendon is anchored at a fixed structure 16 such as a diaphragm or similar. The clamping device 120 is installed to be surrounding a tendon 20 such that a portion 20*a* of the tendon 20 can be detensioned in a controlled manner by transferring the tendon force to stressbars 140, thereby reaching a nominal force at the portion 20*a*. One or more hydraulic cylinders 160 are involved in this operation.

Figure 2B:
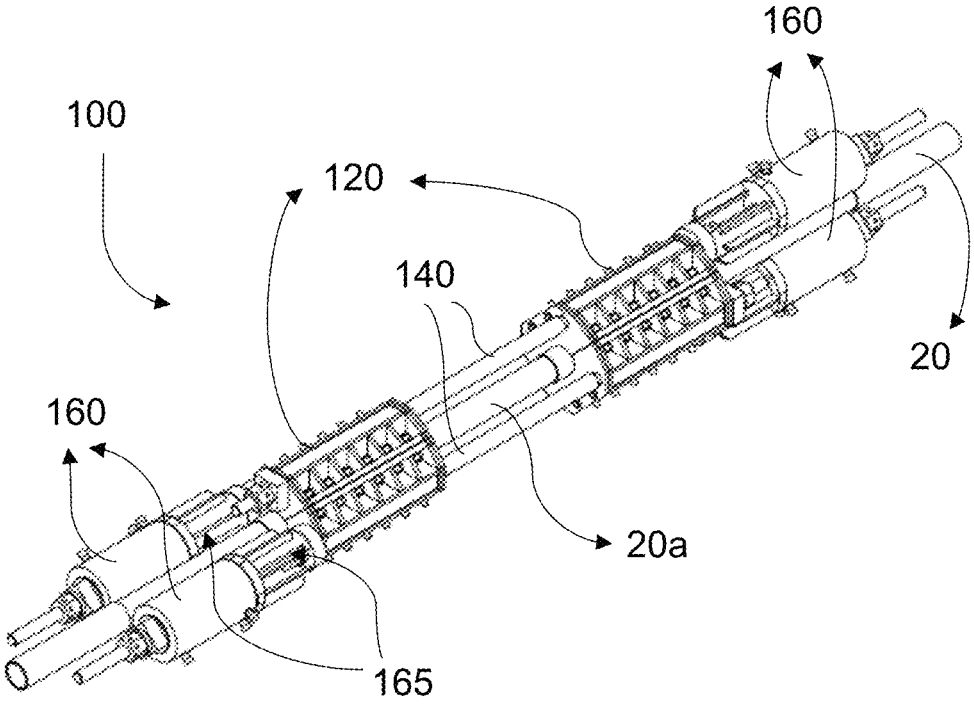
FIG. 2B shows a perspective view of the detensioning system according to one embodiment of the present invention, wherein one clamping device is flanking on each side of the portion of the tendon to be cut.

FIG. 2B shows another embodiment of the detensioning system 100, wherein one clamping device 120 is arranged on each side of the portion 20*a* of the tendon 20 to be cut. This embodiment is suitable for structural element or tensioning element with a pre-tensioned tendon force of about 3000 to 4300 kN. For instance, two hydraulic cylinders 160 (on each clamping device 120) and two stressbars 140 are employed in this embodiment. Each of the clamping device 120 may be subject to 3000 kN, restrained by the two stressbars 140 which are diagonally placed, and each of the stressbars may be stressed to 1500 kN so as to allow the reduction of the tendon force in the portion 20*a* between the two clamping devices 120 to a nominal force before being cut.

Figure 2C:
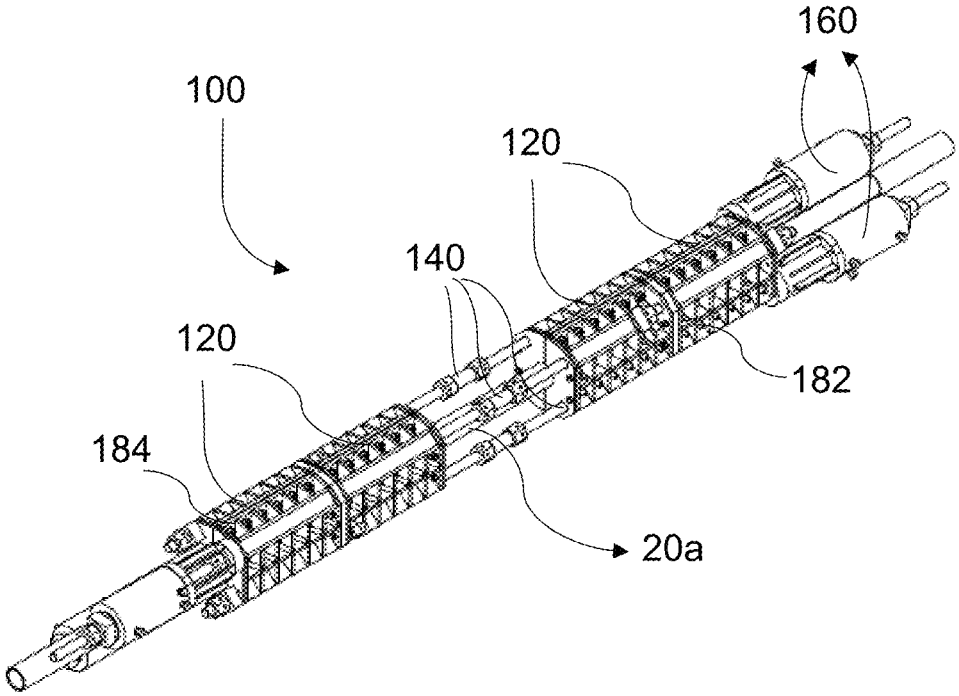
FIG. 2C shows a perspective view of the detensioning system according to one embodiment of the present invention, wherein two clamping devices are flanking on each side of the portion of the tendon to be cut.

FIG. 2C is similar to the FIG. 2B with the exception that a total of four clamping devices 120 and four stressbars 140 are employed in the detensioning system 100. In this example, the detensioning system 100 is suitable to be used for example for tendon size 5-43 (0.5", 43 strands) or 6-37 (0.6", 37 strands), having a higher pre-tensioned tendon force of about 7750 kN.

In the above exemplified embodiments, once the set-up of the detensioning system 100 is in place, the tendon force (of the tendon to be replaced 20) in the portion 20*a* can be transferred to the detensioning system 100 such to the stressbars 140 with the help of for instance hydraulic cylinders 160 (e.g. centre hole jacks) mounted on one or both sides of the clamping devices 120.

Thanks to the conical clamping device 120 which comprises an elongated and annular cavity 55*c*, wherein the cavity 55*c* comprises a gradually declining diameter along a longitudinal axis X of the annular cavity (FIG. 3A), the gripping force exerted by the clamping device 120 in such a configuration is better than the gripping force exerted by a substantially rectangular annular cavity. For this reason, the clamping device 120 having such internal surface profile with at least a peak and a groove can be provided in a more compact size compared to a clamping device having a substantially rectangular annular cavity. It has been found that such clamping device 120 gives an optimum performance in terms of coefficient of friction between the clamping device 120 and inner element 55, as well as between the inner element 55 and the tendon 20.

Figure 3A:
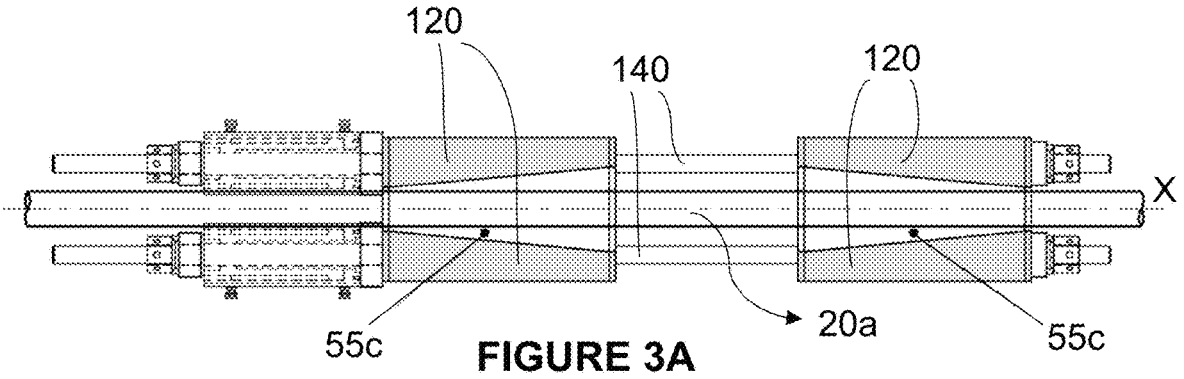
FIG. 3A shows a schematic view of the detensioning system according to one embodiment of the invention, wherein each of the clamping device comprises one segment formed by the substantially elongated, annular cavity having a gradually declining diameter along a longitudinal axis of the annular cavity.
Figure 3B:
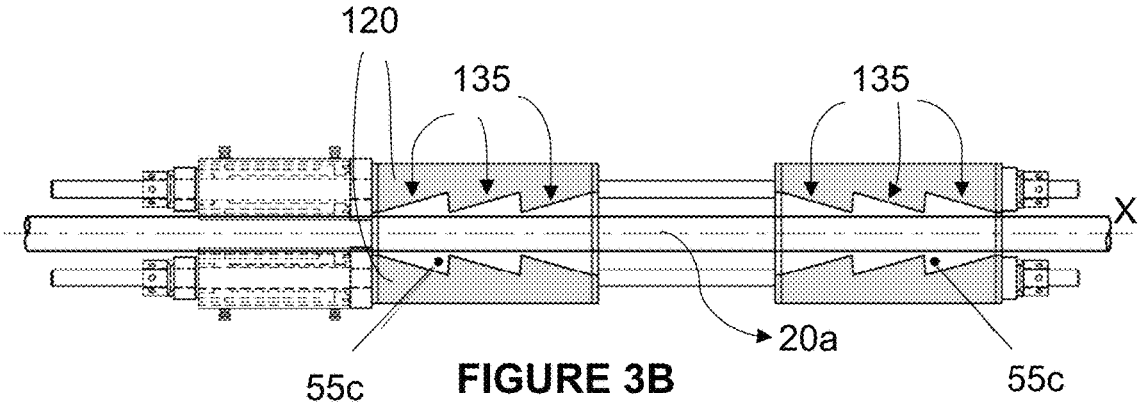
FIG. 3B shows a schematic view of the detensioning system according to one embodiment of the invention, wherein each of the clamping device comprises three segments formed by the substantially elongated, annular cavity having repeated gradually declining diameters along a longitudinal axis of the annular cavity shaped by multiple peaks and grooves of the internal surface profile of the clamping device.

FIG. 3B illustrates a further embodiment of the invention, wherein the annular cavity 55*c* can be provided to comprise more than one segment. In this embodiment, three segments 135 shaped by multiple grooves 133 and peaks 134 (see also FIG. 3C) of the internal surface profile of the clamping device 120 are shown. The inventors of the present invention found out that when a six segmented annular cavity 55*c* is provided to the clamping device 120 (FIG. 3C), an even higher gripping force can be achieved. Such clamping device 120 can therefore achieve similar gripping force exerted by the clamping devices shown for example in FIG. 3A and FIG. 3B but having much smaller size. This is advantageous when a limited space is available on site.

Figure 3C:
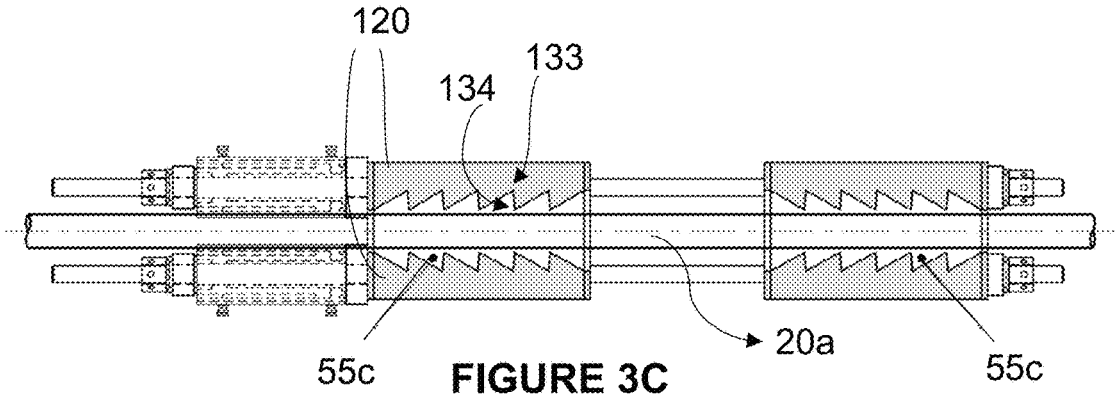
FIG. 3C shows a schematic view of the detensioning system according to one embodiment of the invention, where each of the clamping device comprises six segments formed by the substantially elongated, annular cavity having repeated gradually declining diameters along a longitudinal axis of the annular cavity shaped by multiple peaks and grooves of the internal surface profile of the clamping device.

As the clamping devices 120 are designed to comprise an annular cavity 55*c* comprising a gradually declining diameter along a longitudinal axis X of the annular cavity, the gripping force of such a clamping device 120 having a unique internal surface profile (e.g. wedge shape profile when viewed from a longitudinal section) is higher, therefore tendon force in the portion 20*a* can thus be effectively reduced to a nominal force through the smaller size clamping device 120, as shown in the examples demonstrated in the FIGS. 3A to 3C. The inventor found out while the number of segments 135 can be provided ranging between one to ten, a six segmented annular cavity 55*c* provided by the clamping device 120 seems to be the most optimal.

Figure 4A:
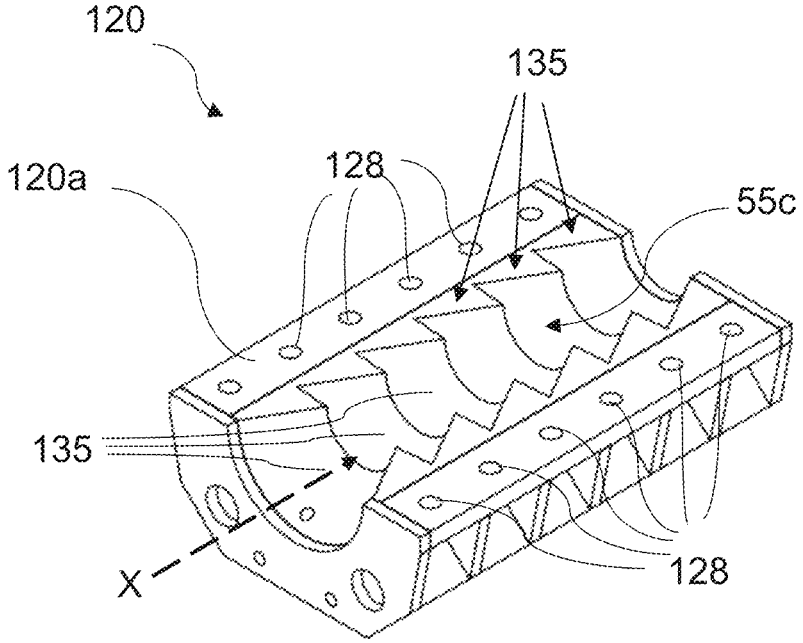
FIGS. 4A and 4B show a schematic perspective view of the clamping device according to one embodiment of the invention, comprising two half clamps ("U-shape"), forming a conical clamping device having an elongated, annular cavity within.
Figure 4B:
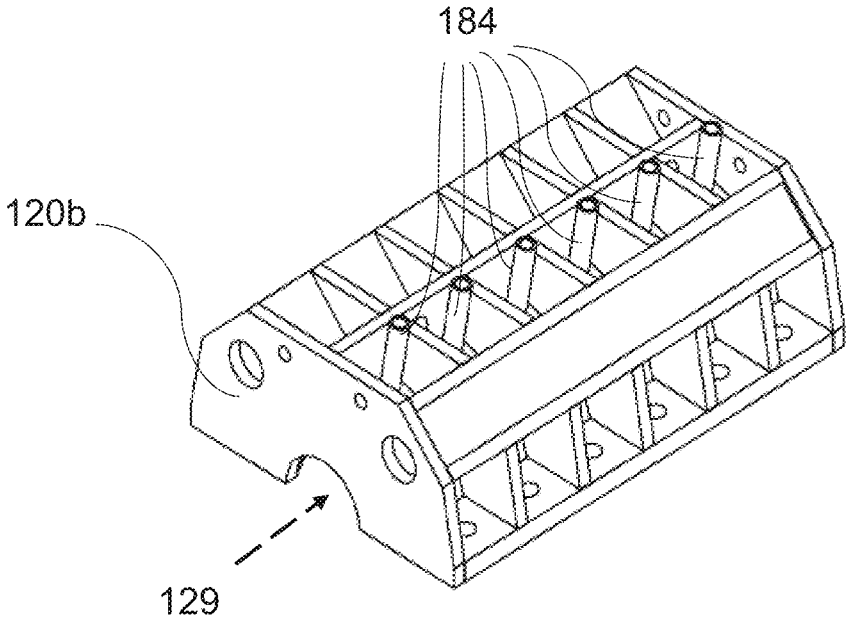

FIGS. 4A and 4B demonstrate an example of the clamping device 120 according to yet a further embodiment of the invention which is applicable to all previously described embodiments. The two half clamping devices 120*a*, 120*b*, when aligned on top of each other, form a conical clamping device 120 having an elongated, annular cavity 55*c*. The clamping device 120 comprises an internal surface profile with at least one peak 134 and groove 133 such as to form at least one segment 135. In this example, the clamping device 120 comprises six segments 135, defined by multiple grooves 133 and peaks 134. In other words, the elongated, annular cavity 55*c* comprises six gradually declining diameters along a longitudinal axis X of the annular cavity 55*c* (or the clamping device 120).

A number of bolts may be used to serve as a mechanical fixing means 128 to tighten the two half clamps 120*a*, 120*b* when the two half clamps 120*a*, 120*b* are aligned. In this connection, it is disclosed herein that each of the segment 135 may comprise at least one channel 182 for injecting of the filler hardening material 50 (not shown in FIG. 4B but in FIG. 2C) and at least one channel 184 for venting (shown in FIGS. 4B and 2C). To this end, it is reiterated that the channel 182 for introducing the filler hardening material 50 and the channel 184 for venting of the filler hardening material 50 are indistinguishable from each other. In other words, these vent channels 182, 184 can be used for any of the roles and therefore, the roles are exchangeable although the channel provided facing bottom tends to serve as a channel 182 for injecting filler hardening material 50 while the channel provided facing above tends to serve as a channel 184 for venting filler hardening material 50.

Figure 4C:
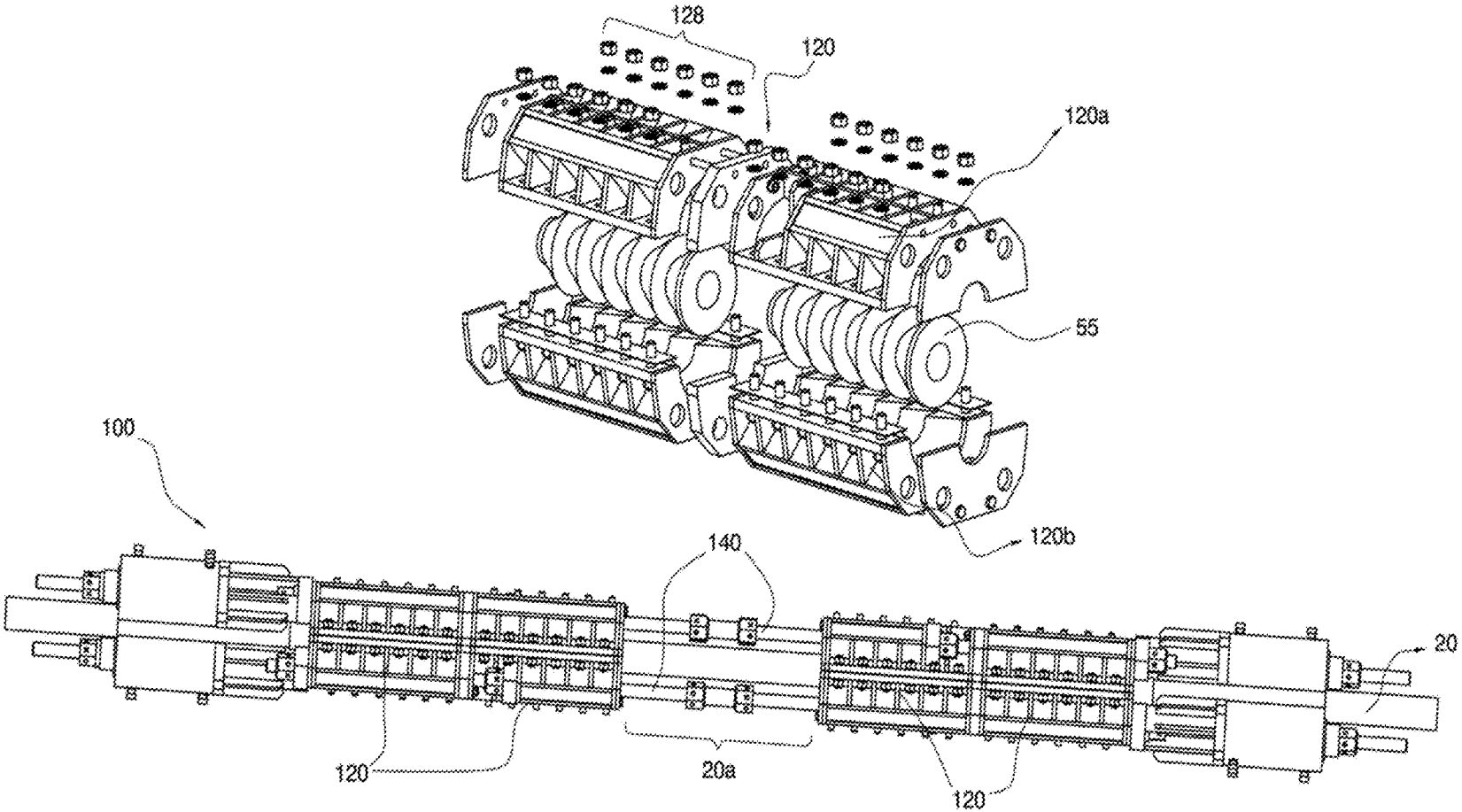
FIG. 4C shows an exploded perspective view of the clamping device according to the embodiment shown in FIG. 2C.

FIG. 4C illustrates an exploded view of the clamping device 120 of the detensioning system 100 according to the embodiment as illustrated in the FIG. 2C, wherein two clamping devices 120 are provided to flank on each side of the portion 20*a* of the tendon 20. In this example, the clamping device 120 may have a diameter of approximately 300 mm, wherein the functioning clamping device 120 may comprise two half clamps 120*a*, 120*b* ("U-shape") which are mechanically assembled together with other mechanical components (e.g. sealing plates, bolts, gasket seals, hydraulic cylinders and etc.) to form a functioning clamping device 120. The annular cavity 55*c* can be occupied by one or more inner elements 55.

It is disclosed herein that the inner element 55 may be a preform which has a pre-determined shape, wherein the one or more inner elements 55 is first provided to surround the tendon 20, subsequently surrounded by the two half clamps 120*a*, 120*b*. Alternatively, the inner element 55 may be formed by injecting a filler hardening material 50 or a grout through the one or more injecting channels 182. The inner elements 55 formed by the filler hardening material generally comprises a reverse impression of the internal surface profile of the clamping device 120.

Figure 5A:
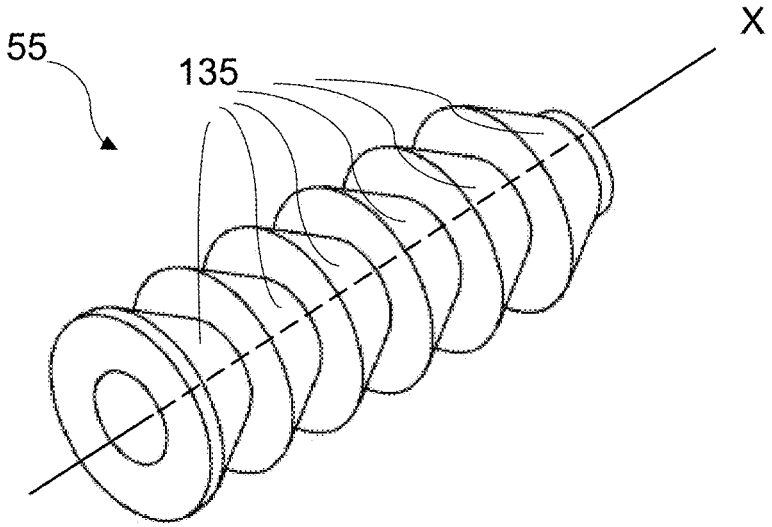
FIGS. 5A and 5B show a schematic perspective view of the inner element according to one embodiment of the invention, wherein the inner element can be introduced into or formed in to the elongated, annular cavity.

FIG. 5A illustrates a representative inner element 55 introduced to the elongated, annular cavity 55*c* according to the embodiment as disclosed in the FIG. 3C. In this embodiment, several repeated declining diameters along the longitudinal axis X of the annular cavity 55*c* defined by multiple grooves and peaks on the internal surface profile of the clamping device forms a multiple segments 135. As can be seen in the FIG. 5A, the annular cavity 55*c* comprises six conical segments 135, wherein the conical segments 135 having without vertices (or vertex) are connected longitudinally to form the inner element 55. In other words, each of the segment 135 comprises a flat circular surface, a curved surface and two edges, wherein one of the edges has a larger diameter than another. The inner element 55 may be a preform which can be introduced into the annular cavity 55*c*, or the inner element 55*cc* may be formed through the injection of the filler hardening material 50 or a grout.

The inner element 55, which are inter-connected longitudinally, when viewed from a longitudinal view, resembles a six wedged shape "teeth" as illustrated in the FIG. 3B. As explained above, it is foreseeable that in every segment 135 (or "tooth"), a injecting channel (or a grout vent) 182 for introducing filler hardening material 50 and a venting channel 184 (or grout vent) for venting of the filler hardening material 50 may be provided at the low or the high point, respectively, of the clamping device 120 (cf. FIG. 4C). Moreover, it is found that for example when the wedge angle α is provided in between 5° and 65°, or between 30° and 40° or most preferably at around 30°, it gives the most optimum gripping force. When the stressbars 140 are being stressed, the "teeth" or segments 135 (formed by the multiple peaks 134 and grooves 133 on the internal surface profile of the clamping device 120) are drawn into the inner element 55, which in turn activates lateral confinement of the clamping device 120 by developing compression diagonal to the pre-stressed tendon 20. Therefore, an optimum force can be transferred from the clamping device 120 to the tendon 20. Similar force transfer is achieved when the pre-tensioning tendon 20 is cut.

Figure 5B:
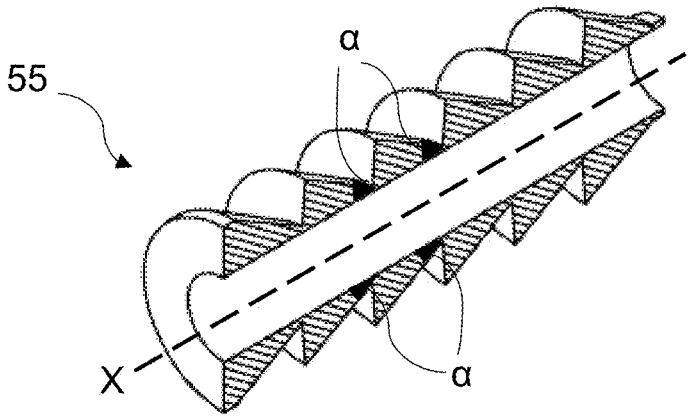
Figure 5C:
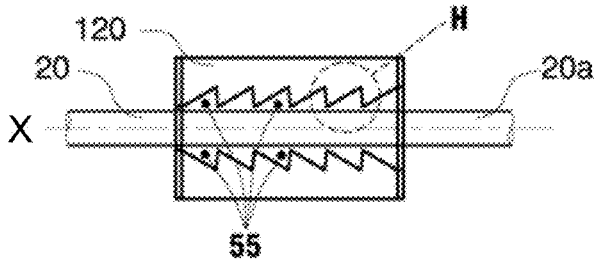
FIGS. 5C and 5D show an elongated, annular cavity having several repeated gradually declining diameters along the longitudinal axis of the annular cavity with a representative wedge angle.
Figure 5D:
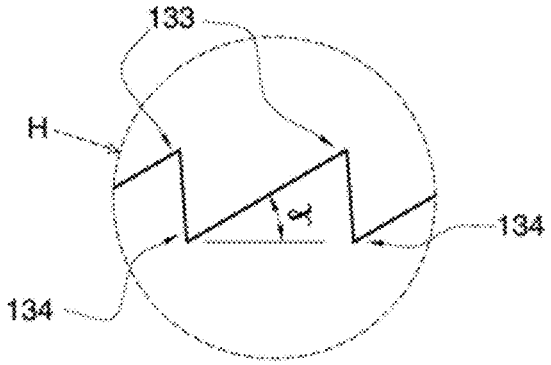

FIG. 5C shows an over-simplified clamping device 120 in a longitudinal section (cross-sectional view), wherein one or more inner elements 55 are provided surrounding a tendon 20. The inner element 55 occupies the empty space of the annular cavity 55*c* provided by the clamping device 120. In this example, the annular cavity comprises six conical segments 135. FIG. 5D is a closed-up view of the region H shown in the FIG. 5C, wherein the clamping device 120 comprises an internal surface profile defined by multiple grooves 133 and peaks 134, forming multiple segments 135. Each of the segment 135 comprises a gradually declining diameter along the longitudinal axis X of the annular cavity 55*c*. When viewed from a longitudinal section as shown in the FIG. 5D, each of the segment 135 of the annular cavity (or equivalent to the inner element 55) comprises a wedge angle α, as shown in the FIGS. 5*b* and 5C. When more segments 125 are provided to the annular cavity 55*c*, the value of wedge angle α are usually higher.

Figure 5E:
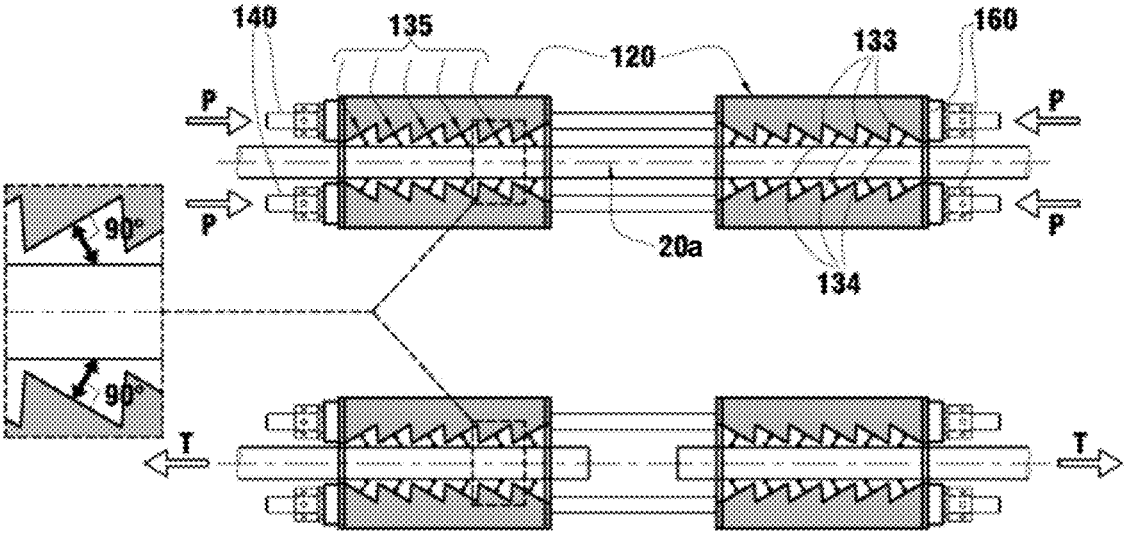
FIG. 5E is a schematic view of the detensioning system according to the present invention showing how the tendon force can be transferred.

FIG. 5E is a schematic representation demonstrating how the tendon force can be transferred. In this embodiment, one clamping device 120 is provided in between the portion 20*a* to be detensioned, wherein the clamping device 120 comprises an annular cavity 55*c* with multiple segments 135, defined by multiple grooves 133 and peaks 134 on the internal surface profile of the clamping device 120. Two stressbars 140 are seen in the FIG. 5E, whereby they are stressed P against each other with the hydraulic cylinders 160 until the portion 20*a* of the tendon force in between the two clamping devices 120 is completely released (transferred to the stressbars 140). Thereafter, as shown in the bottom figure, the portion 20*a* of the tendon can be cut, followed by detensioning the tendon force T of the rest of the tendon in a controlled manner.

Figure 6A:
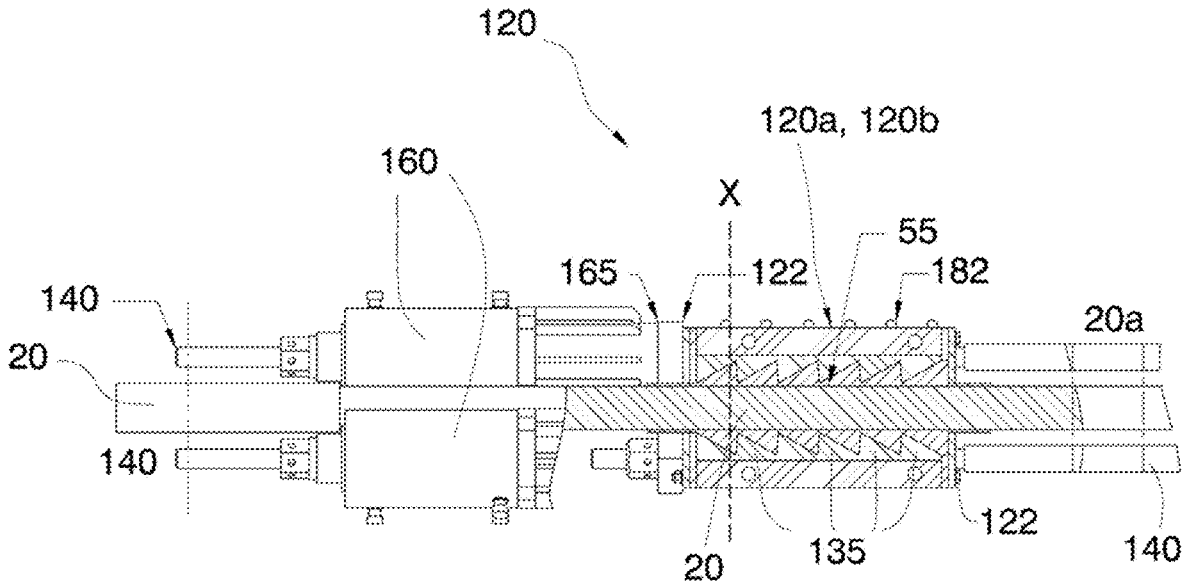
FIG. 6A shows a schematic view of an over-simplified detensioning system according to an embodiment of the invention comprising the installation of the hydraulic cylinders, wherein the hydraulic cylinders are mounted on a stressing chair which in turn is bearing against the stressing clamp.

FIG. 6A shows a close-up view of the clamping device 120 according to an embodiment of the present invention, wherein the clamping device may comprise two half clamps 120*a*, 120*b* and sealing plates 122. The inner element 55 may be formed from a filler hardening material 50 or a grout introduced through injecting channel (not shown in figure but the venting channels 182 are shown). Stressbar hydraulic cylinders 160 are mounted on the respective stressing chairs 165 which in turn are bearing against the clamping device 120. To this end, it is disclosed that the hydraulic cylinders 160 maybe provided directly to the clamping device 120. The portion 20*a* is a representative location where the tendon 20 can be cut once the installation of the detensioning system is ready.

Figure 6B:
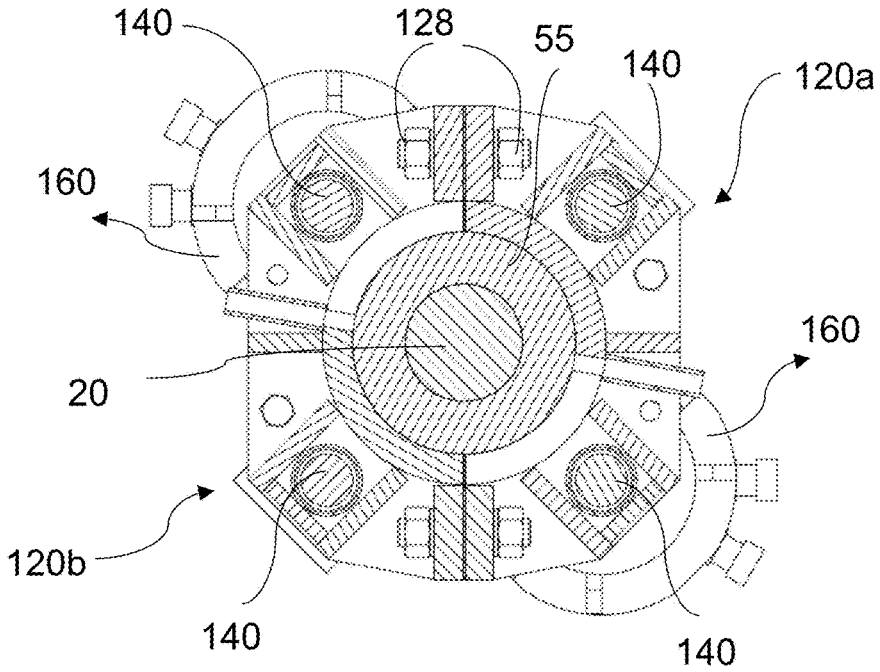
FIG. 6B shows a schematic transverse section of the detensioning system according to the FIG. 6A.

FIG. 6B illustrates a transverse section (or cross-sectional view) of the detensioning system 100 from the location X shown in the FIG. 6A. Two half clamps 120*a*, 120*b* are provided to form the clamping device 120, wherein said two half clamps 120*a*, 120*b* may be provided to tighten the two half clamps 120*a*, 120*b* through a mechanical fixing means 128 e.g. bolts. The clamping device 120 comprises a substantially annular cavity 55*c*, wherein one or more inner elements 55 can be introduced into said cavity, surrounding the tendon 20. Four stressbars 140 are provided to the detensioning system 100 such that when the hydraulic cylinders 160 are actuated, the tendon force is transferred temporarily to the stressbars 140.

The filler hardening material 50 or grout for forming the one or more inner elements 55 may be a high strength epoxy grout (e.g. Sikadur) or a high strength cement-based grout (e.g. Ductal).

For instance, an epoxy-based (e.g. Sikadur) may be used as a filler material 50 for the mould 55 formation. Such filler material 50 are particular suitable to be used for certain applications as it achieves the following properties:

| | |
|---|---|
| Compressive strength: | 89 MPa after 3 days curing time at 23° C.<br>67 MPa after 1 day curing time) |
| Modulus of elasticity: | 18,000 MPa (compression)<br>16,000 MPa (flexure)<br>13,000 MPa (tension) |
| Tensile strength: | 14-16 MPa |
| Shrinkage: | −0.027% to −0.03% |

Alternatively, Ductal or ultra-high-performance cement-based grout with early strength development may be used to form the inner element 55. The ductal or ultra-high-performance cement-based grout is based on the following properties:

| | |
|---|---|
| Compressive strength: | 150 MPa after 28 days;<br>Minimum 100 MPa after 5 days |
| Modulus of Elasticity: | 56,000 MPa |
| Tensile strength: | 8.5 MPa |

The de-tensioning system 100 according to the present invention comprises clamping devices 120 as well as stressbars 140. Suitable stressbars are for instance high strength bars (Grade 1030 diameter 56) as they comprise good properties as follows:

Type VSL CT Stressbar (Bar Grade 1030), nominal tensile strength 1,030 MPa; Alternatively, SAS Stressbar (Bar Grade Y 1050/1035, nominal tensile strength 1,050 MPa)

| | | |
|---|---|---|
| Nominal Diameter: | 56 mm | (SAS bar diameter 57) |
| Nominal Area: | 2428 $mm^2$ | (SAS bar 2581 $mm^2$) |
| Minimum Characteristic strength Pu: | 2,501 kN | (SAS bar 2671 kN) |
| Modulus of Elasticity: | 200,000 MPa | (SAS bar 200,000 MPa) |

A number of hydraulic cylinders 160 (or bar jacks) may be used in the present invention and not limited to certain jacks. For instance, double-acting hollow core bar jacks (also called centre hole bar jacks) are mounted on top of a stressing chair 165, which in turn is bearing against the back of the clamping devices. The bar jacks are used to stress as well as to de-tension the stressbars 140 after cutting of the tendon 20*a*. Ideally, the bar jacks should be calibrated before use. Suitable bar jacks may have properties as follows:

| | |
|---|---|
| Bar jack type: | double acting hollow core cylinder, CMH 200/300 mm |
| Cylinder capacity: | 200 ton |
| Pressure area: | 279.8 $cm^2$ |
| Max Working pressure: | 700 bar ($kg/cm^2$) |
| Cylinder stroke: | 300 mm or 500 mm or more |
| Outer diameter: | 278 mm |
| Bar jack weight: | 164 kg |

As explained, the tendon force is able to be transferred temporarily to the stressbars 140 of the detensioning system 100, through the clamping devices 120 which is clamped to the tendon 20, as it allows the tendon force in between the clamping devices 120 (the portion 20*a*) to be reduced to a nominal force before the portion 20*a* can be cut. After cutting the tendon 20, the stressbars 140 of the detensioning system 100 are released and detensioned in a controlled manner through the hydraulic cylinders 160, which in turn will release the tendon force over the full tendon length.

Prior to the installation of the clamping devices 120, the sheath and/or grout of the tendon may be chiselled away to increase the friction. After installation of the clamping devices 120, the space between the tendon 20 and clamping device 120 (which is the annular cavity 55*c*) is filled with the inner element 55 (e.g. filler hardening material 50). The internal surface profile of the clamping device 120 comprises at least one groove 133 and peak 134, forming at least a segment 135, wherein the segment 135 comprises a gradually declining diameter along the longitudinal axis X. Such conical annular cavity is advantageous compared to cylindrical annular cavity as it not only enhances the gripping force of the clamping device, it also prevent the displacement of the inner element in the longitudinal axis direction.

According to a most preferred embodiment, the annular cavity 55*c* comprises six segments 135 connected longitudinally, wherein each of the segment 135 are provided in a conical shape (but without the vertex or the tip region). The wedge angle $\alpha$ can be provided in between 10° and 45°, while 30° being the preferred wedge angle.

Example of a Method of Detensioning a Pre-Stressed Tendon

Figure 7A:
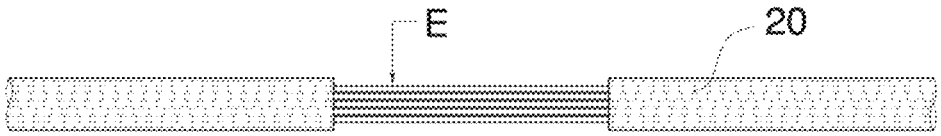
FIGS. 7A to 7L illustrate a schematic step by step installation procedure of the detensioning system to an external tendon or tensioning element to be replaced according to one embodiment of the invention.
Figure 7B:
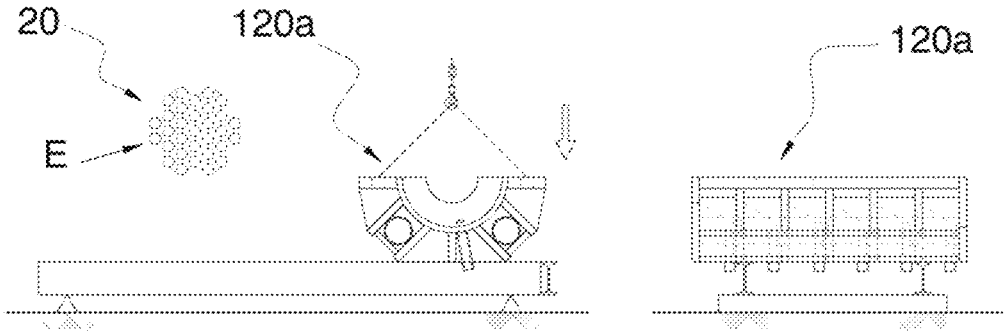
Figure 7C:
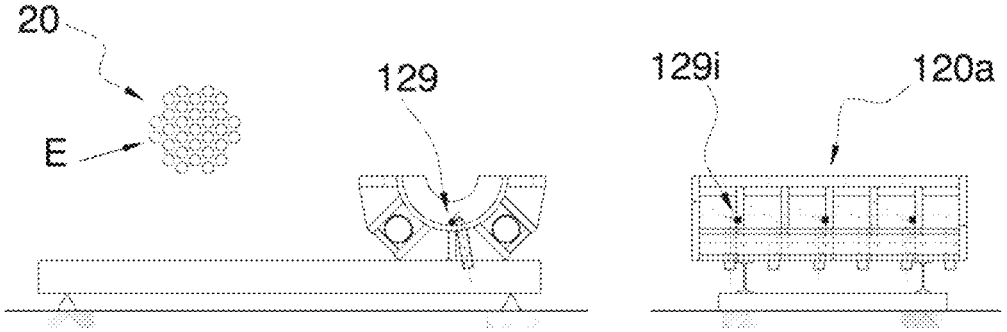

Once the defect or aged tendon is identified, the HDPE around the surface of the tendon 20 where the clamping devices is to be placed may be firstly removed, followed by chiselling away the grout in order to expose the core of the strands E (FIG. 7A). In this connection, all loose grout particles can be removed with e.g. air pressure. Thereafter, lower half of a clamping device 120*a* can be positioned next to the tendon to be cut 20 having a part of an exposed external surface E, on two steel support (FIG. 7B), followed by installing three strain gauges 129 at the internal of lower part of the clamping device 120. FIGS. 7B and 7C demonstrate two different views of the clamping device 120, left picture being viewed from a terminal end while the right picture being viewed from a lateral end.

Figure 7D:
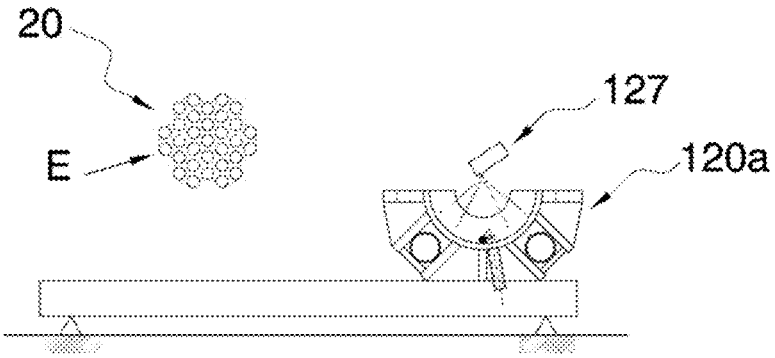
Figure 7E:
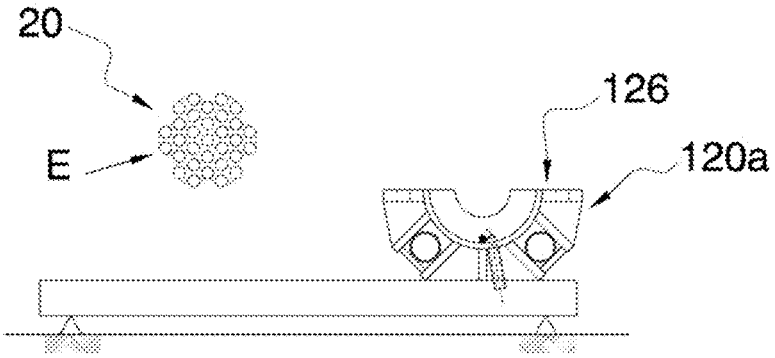
Figure 7F:
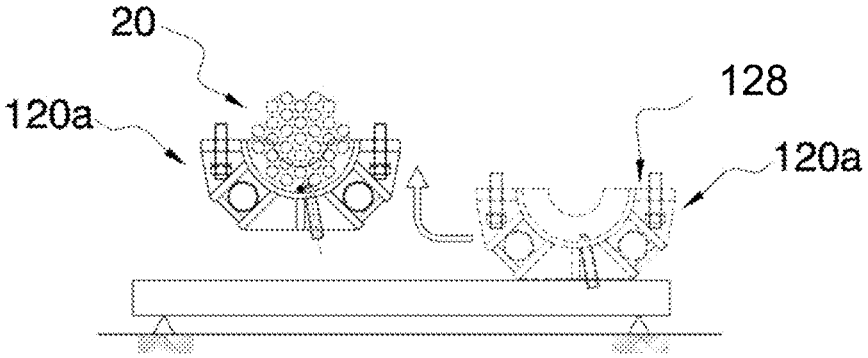

Approximately three strain gauges 129 may then be installed at the lower half of the inside of the clamping device 120*a* (cf: 129*i* of FIG. 7C) which comes out of the grout vent 184 (or each grout vent comprises between one and three strain gauge). Subsequently, a debonding agent 127 (e.g. Lithium spray WD 40 or similar) can be applied on the internal surface of the clamping device 120 (FIG. 7D). Afterwards, compressible rubber gasket 126 can be installed on the flanges of the lower half of the clamping device 120*a* (FIG. 7E), followed by applying mechanical fixing means 128 e.g. bolts (FIG. 7F).

Figure 7G:
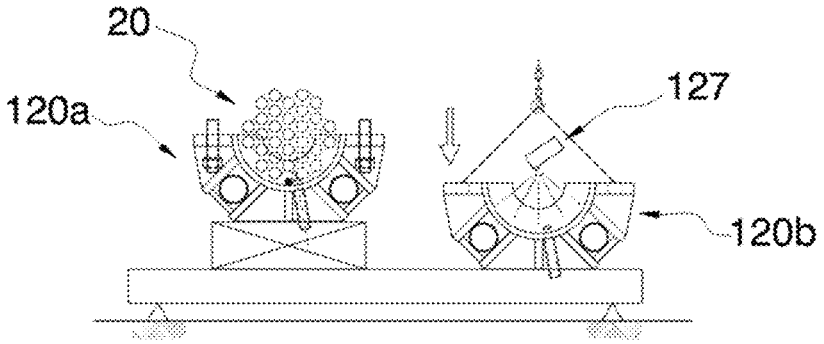
Figure 7H:
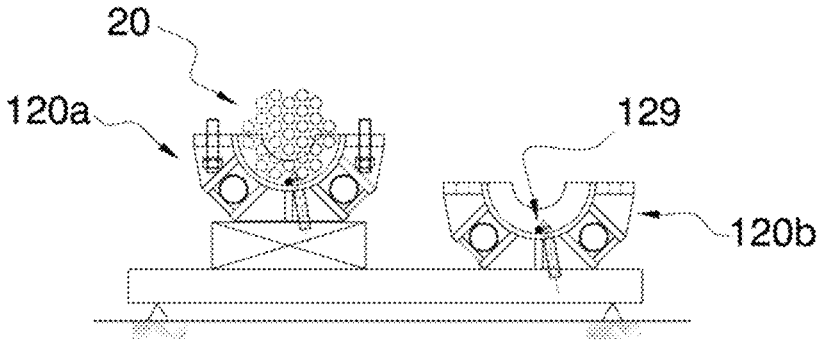
Figure 7I:
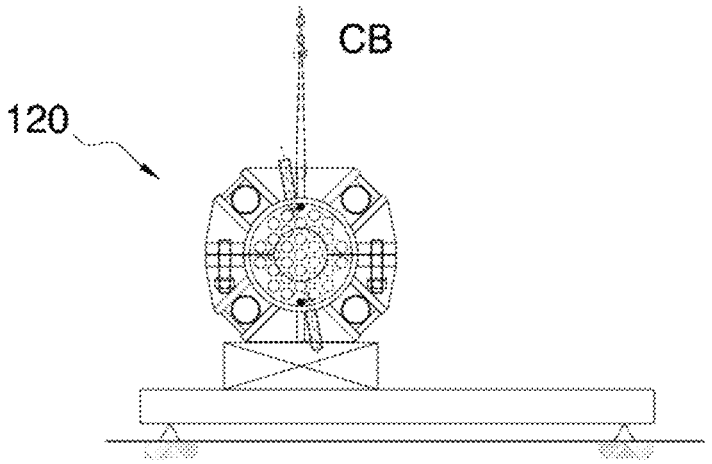

Once the preparation works of the lower half of the clamping device 120*a* is completed, similar preparation works can be repeated to the upper half of the clamping device 120*b*, for instance by applying the debonding agent 127 and the strain gauge 129 as explained (FIGS. 7G, 7H). Once the preparation works on the upper half of the clamping device 120*b* is completed, it can be lifted using chain blocks CB to place and coordinate the position of both the upper and lower half clamps 120*a*, 120*b* (FIG. 71), and followed by installing mechanical fixing means 128 e.g. bolts to form a complete conical clamping device 120. The bolted two half clamps 120*a*, 120*b* are aligned and realigned in order to ensure that the clamping device 120 is centred to the tendon 20. Afterwards, sealing plates 122 can be installed, bearing against HDPE duct, and are then bolted to the clamping devices 120. Additional silicone may be applied to seal the sealing plates 122 against the HDPE duct. Finally, an air tightness test can be carried out with compressed air to check for leakage.

Figure 7J:
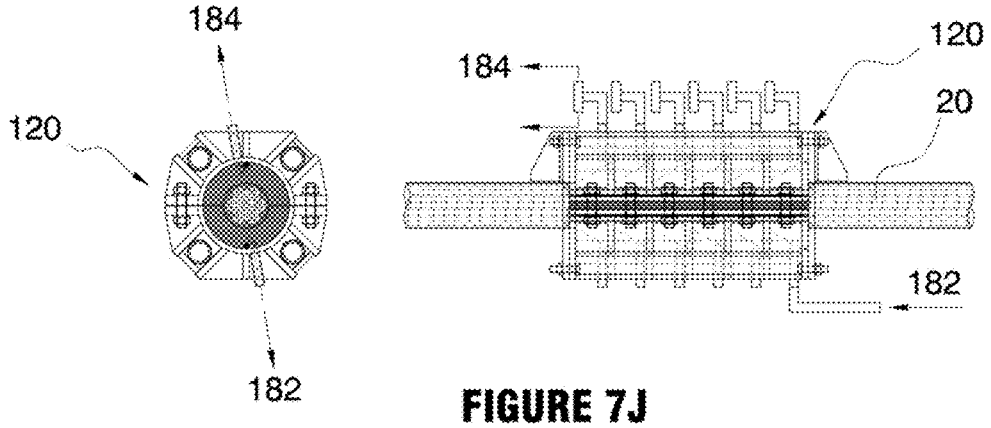

The filler material 50 such as grout can be prepared and introduced through a lower grout vent channel 182 while another channel 184 can be seen in the FIG. 7J for venting purpose. The filler material 50 may be pumped through the lower grout vent channel 182 with a vacuum assistance. A minimum of 3 bars pressure can be used for example to confirm whether the clamping device 120 is fully grouted. After the grouting process, each top grout vent channel 184 can be checked for complete filling of the filler material 50.

Figure 7K:
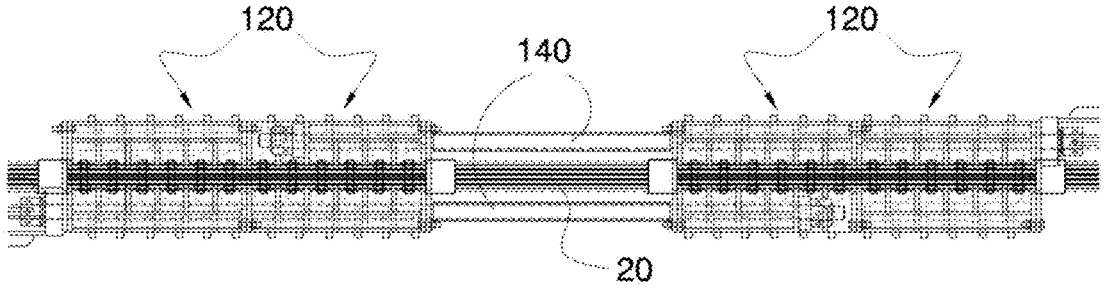

Once the injection of the filler material 50 is completed, stressbars 140 (diameter 56) are installed from one end to the other end of the clamping device 120 (in case one clamping device 120 is provided on each side of the tendon 20 to be cut as shown in FIG. 2A), or overlapping with the intermediate anchorages at inner clamping device (in case two clamping devices 120 is provided on each side of the tendon 20 to be cut as shown in FIG. 2B). FIG. 7K shows an example where two clamping devices 120 are installed on each side of the tendon 20 to be cut. Thereafter, other components of the clamping devices such as bearing plates, spherical washers, bar nuts can be installed, followed by installing stressing chair 165 at the back of the clamping device 120, bearing against the stressbar bearing plate. The bolts can be torqued to (e.g. 385 kN) each, after grout has been cured for at least 24 hours. The torque force is preferably applied in two stages, first being 300 kN and the second being 385 kN. Finally, displacement sensors can be installed for example in between the clamping devices 120 to measure the distance the clamping devices 120, and/or installed against rear of clamps to a fixed reference.

Figure 7L:
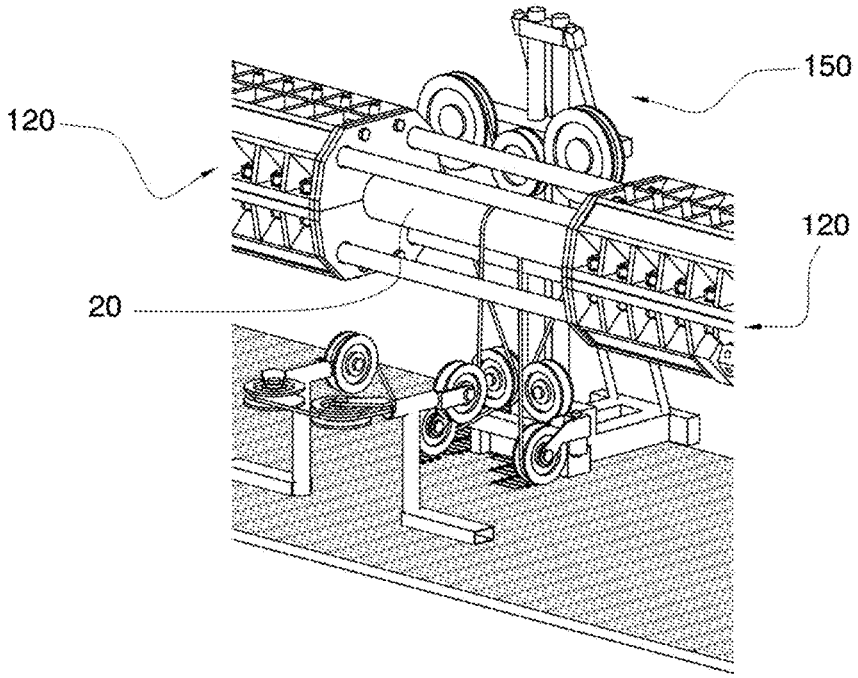

The tendon may then be cut by a diamond wire cutting machine 150 for instance, as illustrated in FIG. 7L. In order to minimize the exposure of the tendon 20 after stressing the clamping devices 120, the diamond wire cutting machine 150 is preferably set up before the stressing operation. The diamond wire cutting machine 150 may be set up to enable remote controlled operation away from the tendon 20. The cutting operation may be monitored by video camera.

Under such set up, the tendon 20 can be cut remotely with the diamond wire cutting machine 150. After the tendon 20 is cut, the force is fully transferred to the stressbars 140 and the clamping devices of the detensioning system 100. Subsequently, the stressbars 140 are released by retracting the centre hole bar jacks. The centre hole bar jacks can be remotely operated. For instance, a retracting of 150 mm of the bar jacks allows the tendon to be fully de-tensioned.

To this end, it is disclosed that for example two type of instrumentations can be installed for monitoring purposes. The first type of the instrumentation is the strain gauges 129 where they are being installed to monitor the stresses of the clamping devices 120. As an example, three strain gauges 129, each may be installed at the lower and the upper half of each clamping device 120*a*, 120*b*. The strain gauges 129 are mounted on the inside of the clamp and are connected with a wire through the grout vent 182.

The second type of the instrumentation is the displacement sensors where they are installed to monitor the movement of the clamping devices during the stressing and de-tensioning operation. In this case, the position of the clamping devices 120 to a fixed reference and the gap between the two clamping devices 120 can be monitored with displacement sensors.

To this end, it is disclosed that several video cameras can furthermore be installed to allow remote controlled monitoring of the critical operation steps without having to go near to the tendon. This enables operations like stressing the stressbars with the bar jacks, monitoring the displacement, cutting and de-tensioning of the tendon to be carried out remote controlled without human intervention. To confirm the tendon has been fully cut, a suitably placed LED strip can be mounted at the cutting location of the tendon, providing a signal at the monitoring station when the tendon is fully disconnected.

The invention claimed is:

1. A detensioning system for detensioning a portion of a structural element or a tensioning element, comprising a first clamping device arranged on at least one side of the portion of the structural element or the tensioning element to be detensioned, wherein the first clamping device has an internal surface profile, arranged to form an elongated, annular cavity surrounding the structural element or the tensioning element to be detensioned, comprising an empty space for receiving one or more inner elements to be introduced therein, wherein the elongated, annular cavity comprises a gradually declining diameter along a longitudinal axis of the elongated annular cavity shaped by at least one peak and one groove of the internal surface profile of the first clamping device;

two or more stressbars connected to and extending from a first end of the first clamping device; and two or more stressbar hydraulic cylinders, wherein each of the stressbar hydraulic cylinders is either mounted directly on the first clamping device, or on a stressing chair which in turn is bearing against the first clamping device.

2. The detensioning system according to claim 1, further comprising a second clamping device, wherein each of the first and second clamping devices is formed by at least two half clamps, wherein the two half clamps are joined together by mechanical fixing means, wherein the first and second clamping devices are provided to each side, respectively, of the portion of the structural element or the tensioning element to be detensioned.

3. The detensioning system according to claim 2, wherein the mechanical fixing means include high strength bolts, debonding agent, sealing plates, sealant or stressbars.

4. The detensioning system according to claim 1, wherein the elongated, annular cavity has multiple segments, defined by multiple said grooves and said peaks, wherein each segment of the multiple segments comprises said gradually declining diameter along the longitudinal axis of the elongated, annular cavity.

5. The detensioning system according to claim 1, wherein the elongated, annular cavity comprises one or more segments, wherein each said segment comprises at least one first channel configured to introduce a filler hardening material and at least one second channel for venting of the filler hardening material, wherein the filler hardening material is introduced through the at least one first channel into the elongated, annular cavity such that the one or more inner elements that is hardened comprises a reversed impression of the internal surface profile of the first clamping device.

6. The detensioning system according to claim 1, wherein the elongated, annular cavity comprises one or more segments, wherein each said segment is provided in a trapezoidal or a conical form, or a wedge when viewed from a longitudinal section, so as to increase a longitudinal force transferred between the structural element or the tensioning element to be detensioned and the first clamping device, through the one or more inner elements.

7. The detensioning system according to claim 1, wherein the elongated, annular cavity comprises one or more segments, wherein each said segment is provided with same or different volumetric capacity for accepting filler hardening material for the formation of the one or more inner elements such that each said segment of the one or more inner elements comprises the same or different amount of the filler hardening material.

8. The detensioning system according to claim 1, wherein the elongated, annular cavity comprises a periphery with edges and/or a substantially linear periphery.

9. The detensioning system according to claim 1, wherein the internal surface profile defines between two and ten segments, defined by multiple grooves and peaks, wherein each said segment is provided in a conical shape, or a wedge when viewed from a longitudinal section.

10. The detensioning system according to claim 1, wherein the elongated, annular cavity comprises one or more segments, wherein each said segment is provided in form of a trapezoid or a cone, or a wedge when viewed from a longitudinal section, wherein a wedge angle is provided in between 5° and 65°.

11. The detensioning system according to claim 1, further comprising a second clamping device, wherein one or more displacement sensors are provided either in between the first and second clamping devices located on respective sides of the portion of the structural element or the tensioning element to be detensioned, or to a far end of each of the first and second clamping devices to a fixed reference.

12. The detensioning system according to claim 1, wherein strain gauges are provided to the detensioning system and are mounted on a surface of the portion of the structural element or tensioning element to be detensioned, in a filler material and/or at fixings between two half clamps of the first clamping device.

13. The detensioning system according to claim 1, further comprising a second clamping device, wherein the two or more stressbars are connected to a first end of the second clamping device, and wherein the first end of the first clamping device faces the first end of the second clamping device.

14. The detensioning system according to claim 1, wherein the two or more stressbars are configured to be connected to an anchored structure.

15. The detensioning system according to claim 1, wherein the two or more stressbar hydraulic cylinders are disposed adjacent a second end of the first clamping device, said second end being opposite to said first end.

16. The detensioning system according to claim 15, wherein the first clamping device is linearly disposed between the two or more stress bars and the two or more stressbar hydraulic cylinders.

17. A method for detensioning a portion of a structural element or a tensioning element using the detensioning system according to claim 1, comprising:

injecting a filler hardening material into the elongated, annular cavity to create the one or more inner elements; and detensioning said portion of said structural element or said tensioning element via said one or more inner elements.

18. A detensioning method for detensioning a portion of a structural element or a tensioning element, comprising the following steps:

a) removing of sheath and/or grout covering the portion of the structural element or the tensioning element in case such sheath and/or grout is present, thereby exposing a core element of the structural element or the tensioning element;

b) placing first and second clamping devices on the exposed core element, wherein the first and second clamping devices are positioned between the portion of the structural element or the tensioning element to be detensioned, wherein each clamping device of the first and second clamping devices has an internal surface profile is configured to form an elongated, annular cavity surrounding the structural element or the tensioning element to be detensioned, comprising an empty space configured to introduce one or more inner elements within the elongated, annular cavity, wherein the elongated, annular cavity comprises a gradually declining diameter along a longitudinal axis of the elongated, annular cavity shaped by at least one peak and one groove of the internal surface profile;

c) joining the first and second clamping devices with at least two stressbars;

d) activating stressbar hydraulic cylinders which are mounted either directly to the first and second clamping devices, respectively, or mounted on a respective stressing chair which in turn is bearing against a corresponding one of the first and second clamping devices in order to transfer a load from the structural element or the tensioning element to the at least two stressbars, wherein the stressbar hydraulic cylinders are actuated until reaching approximately the same or slightly below an original load carried by the structural element or the tensioning element;

e) retaining the load transferred to the at least two stressbars joining the first and second clamping devices;

f) cutting the exposed core element of the portion of the structural element or the tensioning element to be detensioned while holding the load and strain of the structural element or the tensioning element;

g) relaxing the stressbar hydraulic cylinders until the portion of the structural element or the tensioning element is completely detensioned.

19. The detensioning method according to claim 18, further comprising one or more steps of:

a) injecting a filler hardening material into the elongated, annular cavity of each of the first and second clamping devices through at least one channel for introducing the filler hardening material to form the one or more inner elements having reversed impression of the internal surface of a corresponding one of the first and second clamping;

b) mounting or installing strain gauges and/or mechanical fixing means to each of the first and second clamping devices;

c) applying a debonding agent on surfaces of the elongated, annular cavity formed by each of the first and second clamping devices in order to minimize friction between the first and second clamping devices and the filler hardening material;

d) flanging both ends of each of the first and second clamping devices;

e) forming the first and second clamping devices, each comprising a lower half clamp and an upper half clamp, by first installing said lower half clamp followed by said upper half clamp at a desired position before aligning and bolting the lower and upper half clamps together;

f) providing one or more sealing plates and/or sealant to the elongated, annular cavity of each of said first and second clamping devices before injecting the filler hardening material into the elongated, annular cavity of each of said first and second clamping devices;

g) performing a leak tightness test by applying vacuum before injection of the filler hardening material;

h) vacuum-assisted injection of the filler hardening material;

i) providing and setting up a cutting machine before activating said stressbar hydraulic cylinders;

j) mounting a wire sensor at a cutting location on the portion of the structural element or tensioning element to be detensioned in order to enable confirmation of cutting;

k) providing displacement sensors, strain gauges, video cameras, wire sensors and/or a microphone to enable remote control monitoring from a centralized control desk from a safe working zone.

* * * * *